US006753624B2

(12) United States Patent
Miwa

(10) Patent No.: US 6,753,624 B2
(45) Date of Patent: Jun. 22, 2004

(54) ARC DISCHARGE PREVENTION CONNECTOR AND ARC DISCHARGE PREVENTION CIRCUIT

(75) Inventor: Takeya Miwa, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 153 days.

(21) Appl. No.: 09/795,125

(22) Filed: Mar. 1, 2001

(65) Prior Publication Data

US 2002/0047310 A1 Apr. 25, 2002

(30) Foreign Application Priority Data

Mar. 2, 2000 (JP) ..... P 2000-057489

(51) Int. Cl.[7] ..... H01R 9/00
(52) U.S. Cl. ..... 307/112
(58) Field of Search ..... 307/112, 116, 307/125, 134, 135; 361/2, 3

(56) References Cited

U.S. PATENT DOCUMENTS

| | | | | |
|---|---|---|---|---|
| 2,943,213 A | | 6/1960 | Green | |
| 4,346,419 A | * | 8/1982 | Janniello | 307/112 |
| 4,628,392 A | * | 12/1986 | Didier | 361/2 |
| 5,088,931 A | | 2/1992 | Niciolo et al. | |
| 5,176,528 A | * | 1/1993 | Fry et al. | 439/181 |

FOREIGN PATENT DOCUMENTS

| | | |
|---|---|---|
| DE | 32 12 983 A1 | 11/1982 |
| DE | 34 46 396 A1 | 6/1985 |
| DE | 198 38 492 A1 | 3/2000 |
| EP | 0545501 A2 | 6/1993 |
| EP | 0644622 A2 | 3/1995 |
| EP | 0740372 A2 | 10/1996 |
| GB | 2097604 | 11/1982 |
| GB | 2315373 | 1/1998 |
| JP | 8138797 A | 5/1996 |
| WO | WO 00/11758 | 3/2000 |

* cited by examiner

*Primary Examiner*—Gregory J. Toatley, Jr.
(74) *Attorney, Agent, or Firm*—Finnegan, Henderson, Farabow, Garrett & Dunner, LLP

(57) ABSTRACT

A first connection terminal for main power supply 15 and a first connection terminal for signal 16 are disposed in a female connector housing 14. A second connection terminal for main power supply 18 and a second connection terminal for signal 19 are disposed in a male connector housing 17. As the female and male connector housings 14, 17 are fitted to each other, the first connection terminal for main power supply 15 makes contact with the second connection terminal for main power supply 18 before the first connection terminal for signal 16 makes contact with the second connection terminal for signal 19. As the female and male connector housings 14, 17 are disengaged from each other, the first connection terminal for signal 16 breaks contact with the second connection terminal for signal 19 before the first connection terminal for main power supply 15 breaks contact with the second connection terminal for main power supply 18.

10 Claims, 4 Drawing Sheets

ARC DISCHARGE PREVENTION CONNECTOR AND ARC DISCHARGE PREVENTION CIRCUIT

BACKGROUND OF THE INVENTION

1. Field of the Invention

This invention relates to an arc discharge prevention connector and an arc discharge prevention circuit each having a contact protection function.

2. Description of the Related Art

A conventional connector includes a female connector and a male connector which are fitted to each other for connection. The female connector has a female connector housing in which a male connection terminal is housed and fixed. The male connection terminal is disposed so that a tip is protruded into a hood of the female connector housing.

On the other hand, the male connector has a female connector housing in which a female connection terminal is housed and fixed. The female connection terminal has the front end formed in a tubular shape into which the tip of the male connection terminal can be inserted. The female connection terminal also has a connection spring piece at the front end, which piece is folded back obliquely into the internal space of the tube.

However in this connector, when the male connector is fitted into the female connector in a conductive state and the tip of the male connection terminal first makes contact with the front end of the female connection terminal, there occurs such a problem as to generate arc discharge at the contact to deteriorate or damage the contacts. When the connectors are disengaged, the tip of the male connection terminal is lastly disengaged from the front end of the female connection terminal. In this connection, there is a problem of generating arc discharge at the corresponding part to deteriorate or damage the contacts.

SUMMARY OF THE INVENTION

The present invention has been achieved with such points in mind.

It is therefore an object of the invention to provide an arc discharge prevention connector and an arc discharge prevention circuit each having a contact protection function to prevent deterioration of or damage to the tips of connection terminals connected to each other, to protect the tips of the connection terminals.

To achieve the object, according to a first aspect of the invention, there is provided an arc discharge prevention connector comprising: a first and a second connector housings to be fitted to each other; a first connection terminal for main power supply disposed in the first connector housing; a first connection terminal for signal disposed in the first connector housing; a second connection terminal for main power supply disposed in the second connector housing, the second connection terminal for main power supply being arranged to be connected to the first connection terminal for main power supply; and a second connection terminal for signal disposed in the second connector housing, the second connection terminal for signal being arranged to be connected to the first connection terminal for signal, wherein the first connection terminal for main power supply is configured to make contact with the second connection terminal for main power supply before the first connection terminal for signal makes contact with the second connection terminal for signal when the first connector housing and the second connector housing are fitted to each other; and the first connection terminal for signal is configured to break contact with the second connection terminal for signal before the first connection terminal for main power supply breaks contact with the second connection terminal for main power supply when the first connector housing and the second connector housing are disengaged from each other.

Thus in this invention, when the arc discharge prevention connector is set in such a manner that, for example, the first connection terminal for main power supply and the second connection terminal for main power supply come into a conductive state upon the connection between the first connection terminal for signal and the second connection terminal for signal, and conversely, the conductive state of the first connection terminal for main power supply and the second connection terminal for main power supply is broken upon the breaking of the connection between the first connection terminal for signal and the second connection terminal for signal, it becomes possible to prevent the generation of arc discharge between the first connection terminal for main power supply and the second connection terminal for main power supply at the time of the connection or the breaking of the connection. As a result, the first connection terminal for main power supply and the second connection terminal for main power supply can be effectively prevented from deterioration or damage due to arc discharge.

According to a second aspect of the invention, as it depends from the first aspect, the first connection terminal for main power supply and the second connection terminal for main power supply are connected to constitute a main power supply circuit, the first connection terminal for signal and the second connection terminal for signal are connected/disconnected to constitute a switching circuit for switching the main power supply circuit on/off, the first connection terminal for signal makes contact with the second connection terminal for signal after the first connection terminal for main power supply makes contact with the second connection terminal for main power supply in a non-conductive state as the first and second connecter housings are fitted to each other, whereby the switching circuit switches the main power supply circuit to a conductive state, and the first connection terminal for signal breaks contact with the second connection terminal for signal before the first connection terminal for main power supply breaks contact with the second connection terminal for main power supply as the first and second connector housings are disengaged from each other, whereby the switching circuit switches the main power supply circuit to a non-conductive state.

Thus in this invention, arc discharge does not occur between the first connection terminal for main power supply and the second connection terminal for main power supply at the time of the connection and the breaking of the connection. Thus the first connection terminal for main power supply and the second connection terminal for main power supply can be prevented from deterioration or damage. Further, power passed through the first connection terminal for signal and the second connection terminal for signal which constitute the switching circuit can be small for use in signal transmission. Thus arc discharge is unlikely to occur between the first connection terminal for signal and the second connection terminal for signal, or is very weak if generated. Therefore the first connection terminal for signal and the second connection terminal for signal can be prevented from deterioration or damage, resulting in an arc discharge prevention connector with high durability.

According to a third aspect of the invention, as it depends from the first or the second aspect, the first connection terminal for main power supply and the first connection terminal for signal are each provided with contact protrusions, so that the contact protrusions being housed and arranged in the first connector housing in such a manner that the first connection terminal for main power supply protrudes more than the first connection terminal for signal in the forward connecting direction, and the second connection terminal for main power supply and the second connection terminal for signal are put side by side in the second connector housing so that the front ends of the terminals have substantially the same position in the connecting direction.

Further, according to a fourth aspect of the invention, as it depends from the first, the second or the third aspect, the contact protrusion of the first connection terminal for main power supply has a longer length than the contact protrusion of the first connection terminal for signal.

Thus in this invention, the fitting and the disengagement of the first and second connector housings automatically switch the main power supply circuit on/off. Further it has such a simple structure as can be easily produced.

According to a fifth aspect of the invention, there is provided a main power supply circuit to which a main power supply is connected to supply a load piece with electric power, the main power supply circuit being provided with a first connection terminal for main power supply and a second connection terminal for main power supply for making/breaking thereof; and a switching circuit to open/close the main power supply circuit, the switching circuit being provided with a first connection terminal for signal and a second connection terminal for signal for making/breaking thereof, wherein the first connection terminal for main power supply is configured to make contact with the second connection terminal for main power supply before the first connection terminal for signal makes contact with the second connection terminal for signal when the first connection terminal for main power supply is fit into the second connection terminal for main power supply; and wherein the first connection terminal for signal is configured to break contact with the second connection terminal for signal before the first connection terminal for main power supply breaks contact with the second connection terminal for main power supply when the first connection terminal for main power supply is disengaged from the second connection terminal for main power supply.

Thus in this invention, such a main power supply circuit and switching circuit prevent arc discharge between the first connection terminal for main power supply and the second connection terminal for main power supply even at the time of connecting and breaking the connection of the terminals. Thus the first connection terminal for main power supply and the second connection terminal for main power supply can be prevented from being subject to deterioration or damage.

BRIEF DESCRIPTION OF THE ACCOMPANYING DRAWINGS

The above and further objects and novel features of the invention will more fully appear from the following detailed description when the same is read in conjunction with the accompanying drawings, in which.

DETAILED DESCRIPTION OF THE PREFERRED EMBODIMENT

Figure 1:
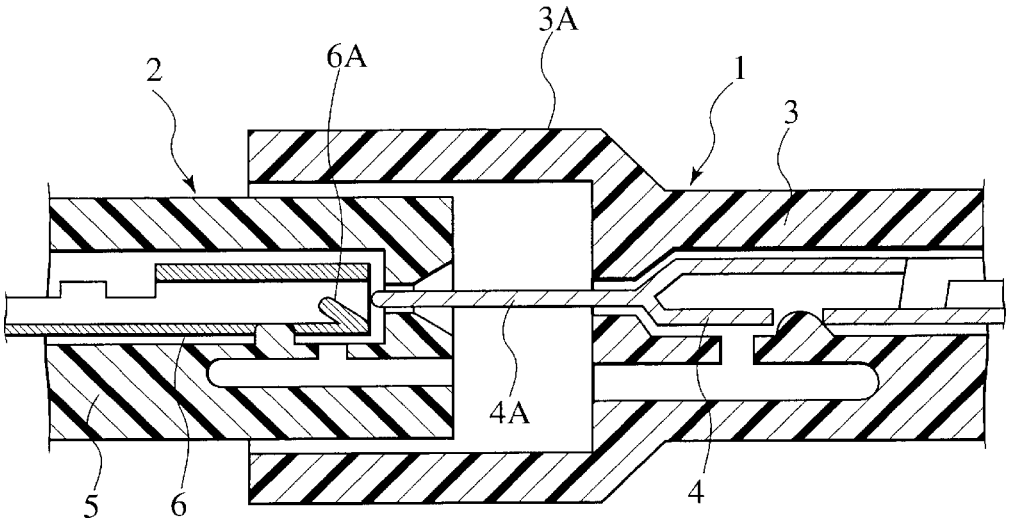
FIG. 1 is a sectional view showing a conventional connector.

There will be detailed below the preferred embodiments of the present invention with reference to the accompanying drawings. Like members are designated by like reference characters.

FIG. 1 shows one embodiment of a connector in which a female connector 1 and a male connector 2 are fitted to each other for connection. The female connector 1 has a female connector housing 3 in which a male connection terminal 4 is housed and fixed. The male connection terminal 4 is disposed so that a tip 4A is protruded into a hood 3A of the female connector housing 3.

On the other hand, the male connector 2 has a female connector housing 5 in which a female connection terminal 6 is housed and fixed. The female connection terminal 6 has the front end formed in a tubular shape into which the tip 4A of the male connection terminal 4 can be inserted. The female connection terminal 6 also has a connection spring piece 6A at the front end, which piece is folded back obliquely into the internal space of the tube.

In the connector of such a structure, when the male connector 2 is fitted into the female connector 1, the tip 4A of the male connection terminal 4 is inserted from the front end of the female connection terminal 6, to come into contact with the connection spring piece 6A as shown in FIG. 1, thereby to establish an electrical connection.

However in this connector, when the male connector 2 is fitted into the female connector 1 in a conductive state and the tip 4A of the male connection terminal 4 first makes contact with the front end of the female connection terminal 6, there occurs such a problem as to generate arc discharge at the contact to deteriorate or damage the contacts. When the connectors are disengaged, the tip 4A of the male connection terminal 4 is lastly disengaged from the front end of the female connection terminal 6. This presents a problem of generating arc discharge at the corresponding part to deteriorate or damage the contacts.

The deterioration of or damage to the contacts prevents good electrical conductivity at the contact between the female and male connection terminals 4 and 6, resulting in a low degree of reliability of the connector.

In this connection, the inventor has improved the connector described above into a connector as another embodiment which will be described hereinbelow.

Therefore, now with reference to FIGS. 2 to 6, an arc discharge prevention connector and an arc discharge prevention circuit according to this invention will be described.

Figure 2:
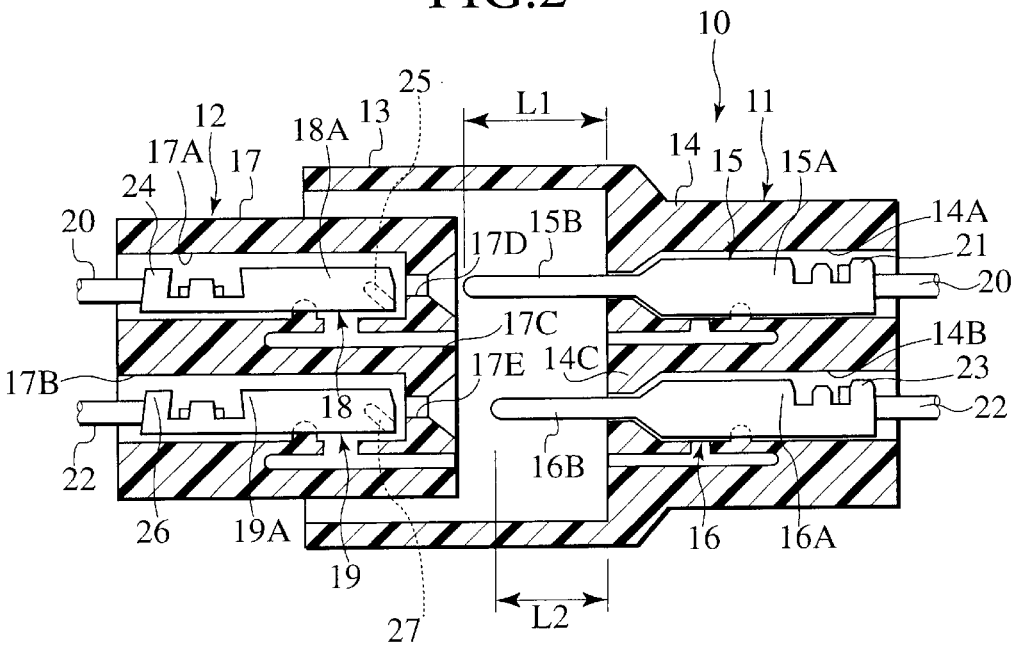
FIG. 2 is a sectional view showing a connector according to this invention in the course of fitting or disengaging.

In FIG. 2, the reference numeral 10 designates an arc discharge prevention connector. The connector 10 comprises a female connector 11 as a first connector and a male connector 12 as a second connector. The female connector 11 has a female connector housing 14 as a first connector housing with a hood 13 formed at its front side, in which a main power supply male terminal 15 as a first connection terminal for main power supply and a signal male terminal 16 as a first connection terminal for signal are housed side by side. The main power supply male terminal 15 and the signal male terminal 16 are held in terminal housing chambers 14A and 14B of the female connector housing 14, respectively.

The male connector 12 has a male connector housing 17 as a second connector housing to be fitted into the hood 13 of the female connector housing 14 at its front side. In the housing 17, a main power supply female terminal 18 as a second connection terminal for main power supply and a signal female terminal 19 as a second connection terminal for signal are put side by side. The main power supply female terminal 18 and the signal female terminal 19 are held in terminal housing chambers 17A and 17B of the male connector housing 17, respectively.

Especially, the main power supply female terminal 18 is arranged to be connected to the main power supply male terminal 15, and the signal female terminal 19 is arranged to be connected to the signal male terminal 16.

Figure 3:
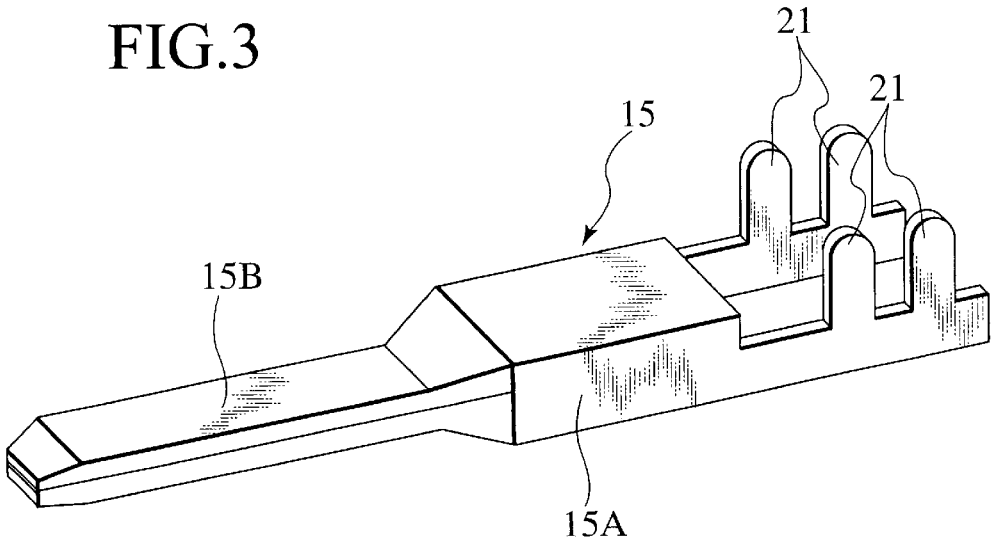
FIG. 3 is a perspective view showing a main power supply male terminal according to the invention.

As shown in FIG. 2, the main power supply male terminal 15 and the signal male terminal 16 have mostly the same structure except that contact protrusions 15B and 16B described later have different lengths $L_1$ and $L_2$. The main power supply male terminal 15 comprises, as shown in FIG. 3, a male terminal body 15A to be supported in the female connector housing 14 and the contact protrusion 15B provided at the front end of the male terminal body 15A. The male terminal body 15A has a plurality of pairs of wire holding pieces 21 formed at its rear part for holding a main power supply wire 20 as shown in FIG. 1.

The female connector housing 14 holding the main power supply male terminal 15 of such a structure has the terminal housing chamber 14A formed therein as described above, in which chamber 14A the male terminal body 15A is held. The contact protrusion 15B of the main power supply male terminal 15 protrudes into the hood 13 through an intermediate wall 14C which distinguishes in space between the terminal housing chamber 14A and the hood 13.

The signal male terminal 16 comprises a signal male terminal body 16A and a contact protrusion 16B like the main power supply male terminal 15. The signal male terminal body 16A has a plurality of pairs of wire holding pieces 23 formed at its rear part for holding a signal wire 22.

In this embodiment, a protrusion length L1 of the contact protrusion 15B of the main power supply male terminal 15 into the hood 13 is set greater than a protrusion length L2 of the contact protrusion 16B of the signal male terminal 16 into the hood 13.

The male connector housing 17 has, as shown in FIG. 2, a front wall 17C at its front end and is provided with the two terminal housing chambers 17A and 17B as described above. In the terminal housing chambers 17A and 17B, the main power supply female terminal 18 and the signal female terminal 19 are inserted from the rear ends and held, respectively. The front wall 17C is provided with protrusion guide holes 17D and 17E penetrating the wall in the cross direction at the positions opposing to the front ends of the main power supply female terminal 18 and the signal female terminal 19, respectively.

Figure 4:
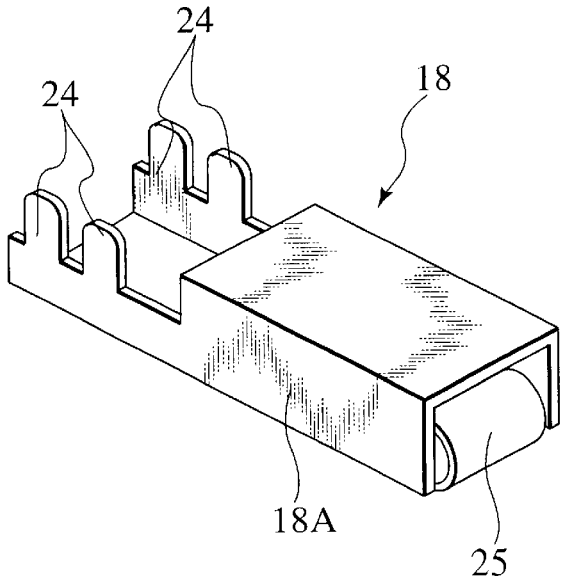
FIG. 4 is a perspective view showing a main power supply female terminal according to the invention.

The main power supply female terminal 18 held in the male connector housing 17 has, as shown in FIGS. 2 and 4, a main power supply female terminal body 18A in a box shape to be housed and held in the male connector housing 17 and a plurality of pairs of wire holding pieces 24 formed at the rear part of the main power supply female terminal body 18A for holding a main power supply wire 20.

On the periphery of the front end opening of the female connection terminal body 18A, a contact spring 25 as a contact folded back inwardly is formed. The contact spring 25 comes into contact with the contact protrusion 15B when the male and female connectors 11 and 12 are fitted to each other. The signal female terminal 19 has mostly the same structure as that of the main power supply female terminal 18. That is, the signal female terminal 19 has a signal female terminal body 19A, a plurality of pairs of wire holding pieces 26 provided at the rear part of the signal female terminal body 19A for holding a signal wire 22, and a contact spring 27 folded back into the signal female terminal body 19A. The front ends of the main power supply female terminal 18 and the signal female terminal 19 are set at the same distance from the front wall 17C of the male connector housing 17.

In the connector 10 of such a structure, when the fitting of the female connector 11 and the male connector 12 is initiated, the contact protrusion 15B of the main power source male terminal 15 protruding into the hood 13 of the female connector housing 14 is inserted into the protrusion guide hole 17D in the front wall 17C of the male connector housing 17, to make contact with the contact spring 25. At this time, the contact protrusion 16B of the signal male terminal 16 is not in contact with the contact spring 27 of the signal female terminal 19 because of the shorter protrusion length L2 thereof than the length of the contact protrusion 15B of the main power supply male terminal 15. When the fitting of the male and female connectors 11 and 12 proceeds further, the signal male terminal 16 and the signal female terminal 19 come into contact with each other, lagging behind the contact between the main power supply male terminal 15 and the main power supply female terminal 18.

Figure 5:
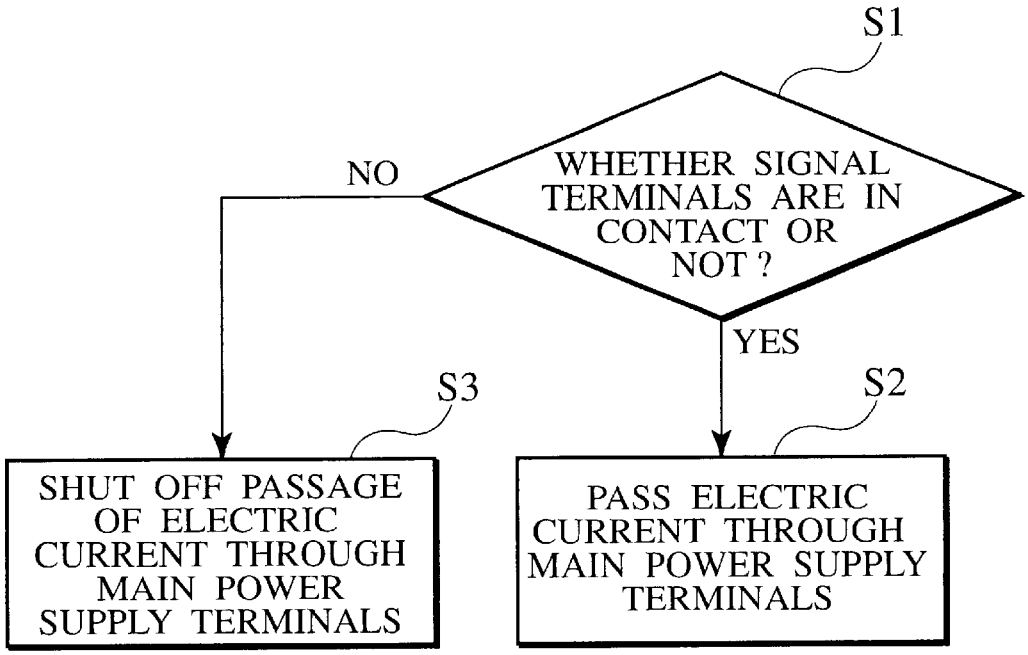
FIG. 5 is a flow chart showing an operation performed in an arc discharge prevention circuit according to the invention.
Figure 6:
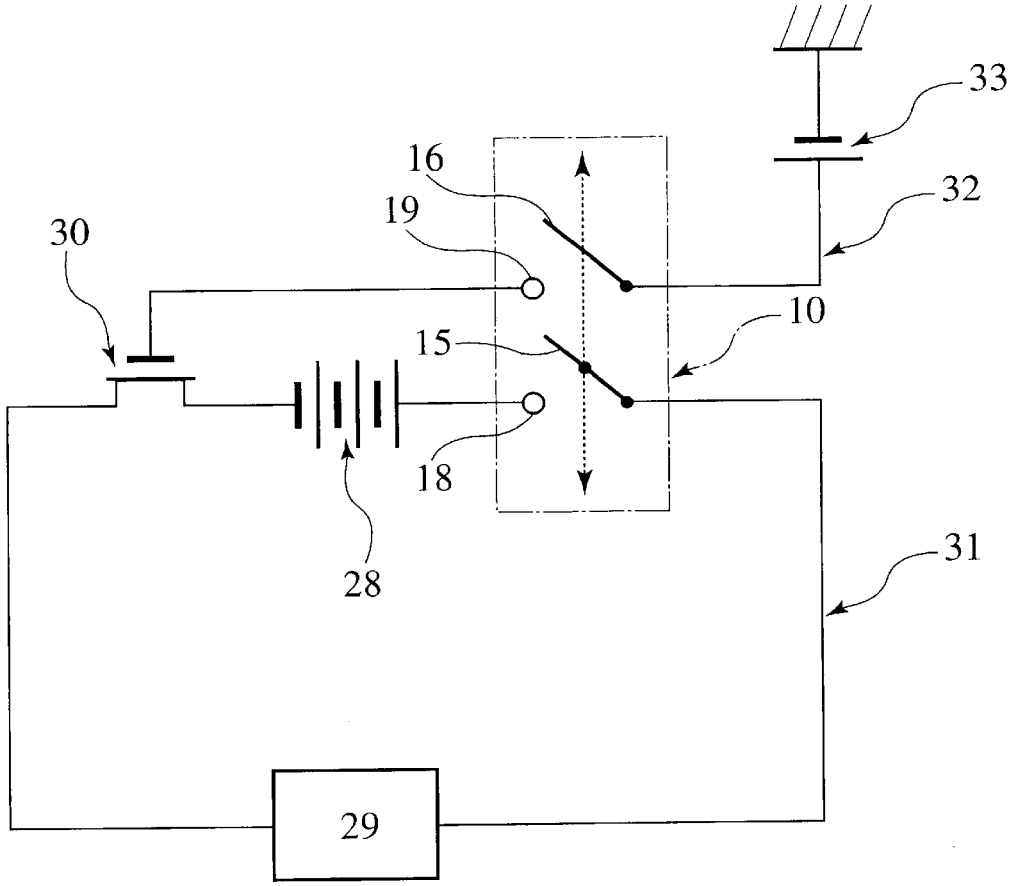
FIG. 6 is an equivalent circuit diagram showing the arc discharge prevention circuit according to the invention.

The arc discharge prevention connector 10 of such a structure in this embodiment controls main power supply as shown in FIG. 5. More specifically, as shown in a flow chart of this figure, it is determined whether or not the signal male terminal 16 and the signal female terminal 19 are in contact (step 1), and when the answer is yes, electric current is passed through the main power supply male terminal 15 and the main power supply female terminal 18 (step 2). When the signal male terminal 16 is in contact with the signal female terminal 19, the main power supply male terminal 15 has already made contact with the main power supply female terminal 18 because of the above-described connector structure. Accordingly, the passage of electric current from the main power supply through the male and female main power supply terminals 15 and 18 in a contacting state does not cause arc discharge between the terminals.

On the other hand, in the case where the signal male terminal 16 is not in contact with the signal female terminal 19 in step S1, the passage of electric current from the main power supply through the main power supply male terminal 15 and the main power supply female terminal 18 is shut off (step S3). More specifically, when the disengagement of the male and female connectors 11 and 12 is initiated, the signal male terminal 16 breaks contact with the signal female terminal 19 before the main power supply male terminal 15 breaks contact with the main power supply female terminal 18 because of the above-described structure. Thus the passage of electric current from the main power supply through the main power supply male terminal 15 and the main power supply female terminal 18 is shut off while these terminals remain in contact. Accordingly, the generation of arc discharge at the instant when the main power supply male terminal 15 is disengaged from the main power supply female terminal 18 can be prevented.

As a means for controlling the passage of electric current from the main power supply as described above, FIG. 6 shows an arc discharge prevention circuit in an equivalent circuit diagram. More specifically, the arc discharge prevention circuit is, as shown in this figure, provided with a main power supply circuit 31 comprising a main power supply 28, a load piece (a load part) 29 and a switching element 30 which are connected in series, and a switching circuit 32 for outputting on/off signals to the switching element 30. The making/breaking of the main power supply circuit 31 and the making/breaking of the switching circuit 32 are performed with the above-described arc discharge prevention connector 10.

As described above, in the arc discharge prevention connector 10, the contact between the signal male terminal 16 and the signal female terminal 19 is established after the establishment of the contact between the main power supply male terminal 15 and the main power supply female terminal 18 in the fitting of the male and female connectors 11 and 12. Thus the switching element 30 is turned on after the main power supply male terminal 15 makes contact with the main power supply female terminal 18, thereby to pass electrical power from the main power supply 28 therethrough. Accordingly, arc discharge is not generated between the main power supply male terminal 15 and the main power supply female terminal 18.

Further, as the female and male connectors 11 and 12 are disengaged from each other, the signal male terminal 16 breaks contact with the signal female terminal 19 before the main power supply male terminal 15 breaks contact with the main power supply female terminal 18, thereby to turn the switching element 30 off. Therefore it is possible to block the passage of electric current from the main power supply 28 before the main power supply male terminal 15 breaks contact with the main power supply female terminal 18. Accordingly, the generation of arc discharge at the instant when the main power supply male terminal 15 is disengaged from the main power supply female terminal 18 can be prevented.

To the switching circuit 32, a signal power supply 33 is connected. The signal power supply 33 supplies feeble power, so that the contact of the signal male terminal 16 and the signal female terminal 19 or the breaking of the contact hardly generates arc discharge. If generated, the generated arc discharge is extremely weak. Therefore deterioration of or damage to the signal male terminal 16 and the signal female terminal 19 can be limited to a minimum.

The entire contents of Japanese Patent Application 2000-057489 (filed on Mar. 2, 2000) are incorporated herein by reference.

Although the invention has been described above by reference to certain embodiment of the invention, the invention is not limited to the embodiment described above.

Modifications and variations of the embodiment described above will occur to those skilled in the art, in light of the above teachings. The scope of the invention is defined with reference to the following claims.

What is claimed is:

1. An arc discharge prevention connector, comprising:

a first connector housing and a second connector housing to be fitted to each other;

a first main power supply terminal disposed in the first connector housing and connected to a main power supply from a first source of electricity;

a first signal terminal disposed in the first connector housing and connected to a signal power supply from a second source of electricity;

a second main power supply terminal disposed in the second connector housing, the second main power supply terminal being arranged so as to connect to the first main power supply terminal;

a second signal terminal disposed in the second connector housing, the second signal terminal being arranged so as to connect to the first signal terminal;

wherein the first main power supply terminal is configured to make contact with the second main power supply terminal before the first signal terminal makes contact with the second signal terminal when the first connector housing and the second connector housing are fitted to each other; and wherein the first signal terminal is configured to break contact with the second signal terminal before the first main power supply terminal breaks contact with the second main power supply terminal when the first connector housing and the second connector housing are disengaged from each other.

2. The arc discharge prevention connector of claim 1, wherein the first main power supply terminal and the second main power supply connection terminal are arranged to form a main power supply circuit;

the first signal terminal and the second signal terminal are arranged to form a switching circuit for switching the main power supply circuit between a nonconductive state and a conductive state;

the first signal terminal is arranged to make contact with the second signal terminal after the first main power supply terminal makes contact with the second main power supply terminal, while the main power supply circuit is in the non-conductive state and as the first and second connecter housings are fitted to each other, such that the switching circuit switches the main power supply circuit from the nonconductive state to the conductive state; and the first signal terminal breaks contact with the second signal terminal before the first main power supply terminal breaks contact with the second main power supply terminal and as the first and second connector housings are disengaged from each other, such that the switching circuit switches the main power supply circuit to the non-conductive state.

3. The arc discharge prevention connector of claim 2, wherein the first main power supply terminal and the first signal terminal are each provided with contact protrusions arranged in the first connector housing such that the first main power terminal protrudes more than the first signal terminal in a forward connecting direction; and the second main power supply terminal and the second signal terminal are arranged side by side relative to one another in the second connector housing so that an opening of the second main power supply terminal is substantially coplanar with an opening of the second signal terminal.

4. The arc discharge prevention connector of claim 3, wherein the contact protrusion of the first main power supply terminal has a longer length than the contact protrusion of the first signal terminal.

5. An arc discharge prevention circuit, comprising:

a main power supply circuit to which a main power supply is connected to supply a load piece with electric power, the main power supply circuit being provided with a first main power supply terminal connected to the main power supply and arranged to be connected to a second main power supply terminal so as to provide main power from a first source of electricity through the main power supply circuit from the main power supply;

a switching circuit arranged to switch the main power supply circuit between an disengaged state and an engaged state, the switching circuit being provided with a first signal terminal connected to a signal power supply and arranged to be connected to a second signal terminal so as to provide signal power from a second source of electricity through the switching circuit;

wherein the first main power supply terminal is configured to make contact with the second main power supply terminal before the first signal terminal makes contact with the second signal terminal when the first main power supply terminal is fit into the second main power supply terminal; and wherein the first signal terminal is configured to break contact with the second signal terminal before the first main power supply terminal breaks contact with the second main power supply terminal when the first main power supply terminal is disengaged from the second main power supply terminal.

6. The arc discharge prevention connector of claim 1, wherein the first main power supply terminal is connected to a load piece by a first main power supply wire, the first signal terminal is connected to the signal power supply by a first signal wire, the second main power supply terminal is connected to the main power supply by a second main power supply wire, and the second signal terminal is connected to a switching element by a second signal wire.

7. The arc discharge prevention connector of claim 6, wherein the load piece, the switching element, and the main power supply are each connected with each other in series so as to form a main power supply circuit.

8. The arc discharge prevention connector of claim 7, wherein the switching element is arranged to switch the main power supply circuit between a disengaged state, where the first signal terminal is not in contact with the second signal terminal, and an engaged state, where the first signal terminal is in contact with the second signal terminal.

9. The arc discharge prevention connector of claim 1, wherein the first connector housing is shaped only to house a single first main power supply terminal and the first signal terminal.

10. The arc discharge prevention circuit of claim 5, wherein the switching circuit is configured to switch the main power supply circuit between the disengaged and engaged states based on whether the first signal terminal is contact with the second signal terminal and whether signal power is provided through the switching circuit from the signal power supply.

* * * * *